US010384818B2

(12) United States Patent
Ehmer

(10) Patent No.: US 10,384,818 B2
(45) Date of Patent: Aug. 20, 2019

(54) METHOD AND DEVICE FOR FORMING PACKAGING UNITS

(71) Applicant: KHS GmbH, Dortmund (DE)

(72) Inventor: Wilfried Ehmer, Dortmund (DE)

(73) Assignee: KHS GmbH, Dortmund (DE)

( * ) Notice: Subject to any disclaimer, the term of this patent is extended or adjusted under 35 U.S.C. 154(b) by 295 days.

(21) Appl. No.: 15/114,539

(22) PCT Filed: Jan. 21, 2015

(86) PCT No.: PCT/EP2015/051072
§ 371 (c)(1),
(2) Date: Jul. 27, 2016

(87) PCT Pub. No.: WO2015/113875
PCT Pub. Date: Aug. 6, 2015

(65) Prior Publication Data

US 2016/0355285 A1 Dec. 8, 2016

(30) Foreign Application Priority Data

Jan. 28, 2014 (DE) ..... 10 2014 100 946

(51) Int. Cl.

| | |
|---|---|
| ***B67B 3/20*** | (2006.01) |
| ***B65B 21/06*** | (2006.01) |
| ***B65B 35/58*** | (2006.01) |
| ***B65B 17/02*** | (2006.01) |
| ***B65B 7/28*** | (2006.01) |
| ***B65B 57/04*** | (2006.01) |

(52) U.S. Cl.
CPC ..... *B65B 17/02* (2013.01); *B65B 7/2835* (2013.01); *B65B 21/06* (2013.01); *B65B 35/58* (2013.01); *B65B 57/04* (2013.01); *B67B 3/2013* (2013.01)

(58) Field of Classification Search
CPC ..... B65B 17/02; B65B 7/2835; B65B 35/56; B65B 35/58; B65B 21/00; B65B 21/06; B65D 69/00; B65D 71/0085; B67B 3/2013–3/2033; B65G 47/244; B65G 2201/0244; B65G 2201/0247; B65C 9/06–9/067
USPC ..... 53/167, 287–369, 484–490, 410, 415, 53/128.1, 135.1, 136.1
See application file for complete search history.

(56) References Cited

U.S. PATENT DOCUMENTS 3,759,373 A * 9/1973 Werth ..... B65D 21/0205 206/139
4,051,366 A * 9/1977 Gordon ..... B65B 35/58 198/378

(Continued)

FOREIGN PATENT DOCUMENTS

DE 102011119966 B3 * 11/2012 ..... B65B 17/02
DE 10 2011 107265 1/2013

(Continued)

*Primary Examiner* — Stephen F. Gerrity
*Assistant Examiner* — Joshua G Kotis
(74) *Attorney, Agent, or Firm* — Occhiuti & Rohlicek LLP

(57) ABSTRACT

A closure unit includes a closure head that closes a container by applying a closure onto a container opening thereof, a grouper that brings closed containers close together to form a bundle of closed containers, and an adhesive applicator that applies adhesive to a circumferential side wall of a container.

20 Claims, 6 Drawing Sheets

(56) References Cited

U.S. PATENT DOCUMENTS

| | | | | |
|---|---|---|---|---|
| 4,437,289 | A * | 3/1984 | Bedin | B65C 3/06 53/136.1 |
| 4,721,544 | A * | 1/1988 | Zodrow | B65C 3/16 156/456 |
| 6,401,905 | B1 * | 6/2002 | Ballarotti | B65B 35/58 198/394 |
| 6,868,652 | B2 * | 3/2005 | Arends | B65B 21/04 198/376 |
| 7,198,070 | B1 * | 4/2007 | Hansen | B65B 17/02 141/20 |
| 7,726,464 | B2 | 6/2010 | Cerf | |
| 8,479,475 | B2 * | 7/2013 | Van Steen | B67C 3/008 141/82 |
| 2005/0138895 | A1 * | 6/2005 | Schach | B65C 9/36 53/415 |
| 2009/0218193 | A1 * | 9/2009 | Malini | B65B 35/58 198/379 |
| 2010/0049357 | A1 * | 2/2010 | Weil | B65C 9/06 700/213 |
| 2010/0308043 | A1 * | 12/2010 | Wimmer | B65B 17/02 220/23.4 |
| 2012/0144777 | A1 * | 6/2012 | Olsen | B65B 27/04 53/398 |
| 2014/0352868 | A1 * | 12/2014 | Ehmer | B65B 17/02 156/60 |

FOREIGN PATENT DOCUMENTS

| | | | | |
|---|---|---|---|---|
| DE | 102011119967 | B3 * | 1/2013 | B65B 17/02 |
| EP | 0414031 | A1 * | 2/1991 | B65C 3/26 |
| EP | 1197468 | A1 * | 4/2002 | B65C 9/067 |
| EP | 1 647 518 | | 4/2006 | |
| EP | 2 258 625 | | 12/2010 | |
| GB | 463 289 | | 3/1937 | |
| WO | WO2013/079128 | | 6/2013 | |

* cited by examiner

METHOD AND DEVICE FOR FORMING PACKAGING UNITS

RELATED APPLICATIONS

This application is the national stage under 35 USC 371 of PCT/EP2015/051072, filed on Jan. 21, 2015, which claims the benefit of the Jan. 28, 2014 priority date of German application DE 102014100946.0, the contents of which are herein incorporated by reference.

FIELD OF INVENTION

The invention relates to a device for producing bundles of containers.

BACKGROUND

Devices and methods for forming packaging units, referred to hereinafter as bundles, are known. These devices generally operate by compiling or forming a plurality of articles to create one article group. This article group is typically held together by shrink film. This shrink film protects the wrapped article group and also makes it easy to transport.

It is also known to connect articles to one another by using an adhesive.

SUMMARY

An object of the invention is to provide a device by means of which an efficient application of adhesive agents to containers is possible, in order, by adhesive bonding of the containers to one another, with minimum effort and expenditure and therefore as economically as possible, to be able to form bundles containing a plurality of containers.

In one embodiment, the invention features a device for closing containers by applying closure elements, or closures, to their container opening. In this situation, open containers are delivered by a container delivery element to a closure unit at which the closure of the containers takes place using a closure head. Provided in the area of the closure unit is at least one adhesive application unit, or adhesive applicator, that applies adhesive onto a circumferential side of the container. The result of this is that the containers are already provided with the application of adhesive in the closure unit, by means of which a plurality of containers, gathered into a bundle, are adhesively bonded to one another, and specifically in each case containers adjacent to one another, by one or more adhesive points. By way of the integration of the adhesive application into the closure unit, the machine effort and expenditure is substantially minimized, since no additional machine or treatment station is necessary for the application of adhesive. In addition to this, advantages are also attained with regard to the propensity to failure of the machine as a whole, and savings in refitting times, for example at a change of format in the containers which are to be treated.

Preferably, the closure unit comprises means for the controlled rotation of the container about the upright axis of the container. By way of these means of controlled rotation, an alignment of the container into a desired position of rotation can be attained. Preferably, therefore, these means for the controlled rotation are provided on the transport section between the container guide and the application unit, such that, before reaching the application unit, the containers are aligned relative to it in such a way that, at a defined point, one or more adhesive applications take place. As a result, the containers can be connected to one another in a desired rotational position, such that, for example, a specific equipping feature, such as an imprint or a label area, exhibits a defined orientation in the bundle. It is additionally also possible for the container to be rotated several times in a controlled manner, and specifically in such a way that, after a first application of adhesive agent, the container is again rotated, in order for an application of adhesive to be made with an application unit at a further predetermined location.

Preferably, the controlled rotation of the container about the upright axis of the container is carried out by the closure head. A closure head which is configured such as to apply a screw closure comprises preferably a rotationally driven effect element, such as to carry out the screwing of the closure onto the container opening. Preferably, by means of this effect element, the alignment of the container into a desired position can be carried out. In this situation, preferably after the closure of the container, the closure head is set on the container, or the closure element located on it, or held in place, and, by controlled drive of the effect element, the container is rotated out of the actual rotation position into the desired rotation position. Advantageously, this allows for the closure head to be used, as well as for the closure, also for the rotating of the container into the desired rotation position.

As an alternative, the controlled rotation of the container about the upright axis thereof can be carried out by a rotation of a contact and/or standing surface, on which the container is in contact and/or stands. In particular, the contact and/or standing surface can be a stand plate, on which the container stands with its container base. Drive means are also envisaged which are in contact on the circumferential side against the container wall, and can cause a controlled rotation of the container about the upright axis of the container.

Preferably, arranged in the area of the closure unit, or upstream of the closure unit, is a sensor unit for the detection of an actual rotation position of the container. By means of this sensor unit, for example, a marking, an equipping feature, or another identifier of the container can be detected, in order for the actual rotation position (actual rotation position) of the container to be determined. The sensor unit can, in particular, be an optical detection unit, by means of which the marking, equipping feature, or the like can be detected. As an alternative, other detection units are also possible, which allow for a determination of the actual rotation position of the container, such as a contour detection unit.

Preferably, a control unit is also provided, which is configured for the reception of information regarding the actual rotation position of the container, and interacts with the means for rotating the container so as to rotate the container out of the actual rotation position into a desired rotation position. The control unit can be formed at the base of the actual rotation position and the desired rotation position for the determination of an angle of rotation, in order to rotate the container about its upright axis. In addition, the control unit is connected, for example, to means for the rotation of the container in such a way, or these means are controlled by the control unit in such a way, that a rotation takes place out of the actual rotation position into the desired rotation position.

In a preferred exemplary embodiment, the means for rotating the container comprise a rotation angle sensor. This rotation angle sensor can, for example, be an incremental sensor. The rotation angle sensor is preferably coupled to an effect element which effects rotation of the container, and can be used, for example, for the determination of the rotation angle about which the container is rotated by the effect element. This therefore allows for a controlled rotation of the container to be achieved in interaction with the control unit.

Preferably, the closure unit comprises a driveable circulating transport element, in particular driven continuously or intermittently, for the transport of containers from the container delivery element to a container outlet. For example, the containers are transferred at the container delivery element to a container carrier or a container holder, which is connected to the moved transport element in such a way that the containers are moved together with the transport element and specifically as far as the container outlet, at which the removal of the containers from the closure unit takes place, for example by an outlet star unit. Preferably, the closure unit comprises a plurality of closure stations moved together with the transport element, which in each case comprise a container carrier or a container holder, and a closure head allocated to said closure carrier or container holder, such that the closure of the containers can take place during transport. In a preferred exemplary embodiment, the transport element is a rotor which can be rotated about a machine upright axis, or a linear conveyor.

According to a further aspect, the invention relates to a device for producing multiple rows of bundles of containers, comprising at least one closure unit, in which filled containers are closed by means of a closure head, and a grouping station for the forming of bundles of closed filled containers. In the area of the closure unit, at least one application unit is provided, by means of which the application of adhesive onto a circumferential side of the wall of the containers takes place. The grouping station is configured to bring a plurality of containers close to one another in such a way that the containers are connected by means of the adhesive mass to form bundles.

Preferably, the grouping station comprises a compacter station or compacter line, on which groups of containers are, at least at time intervals, pressed together to connect the containers to one another by the adhesive mass.

In addition, in the area of the compacter station or compacter line, and/or in the transport direction after the compacter station or compacter line, means can be provided for hardening the adhesive mass. The means for hardening the adhesive mass can be, in particular, UV lamps, by means of which a UV-cured adhesive mass can be cured.

According to a further aspect, the invention also relates to a method for producing bundles from containers, wherein filled containers are delivered to a closure unit, at which closure of the respective container takes place by means of a closure element, wherein a plurality of containers are brought together after closing to form a container group, and are then processed to form a bundle. In the area of the closure unit, in this situation, an adhesive mass is applied onto a circumferential side of the wall of the container. Next, a plurality of containers, which have undergone the application of the adhesive, are brought close to one another in such a way that the containers are connected by means of the adhesive mass to form bundles.

The closure of the containers, the rotation of the container into a desired rotation position, and the application of the adhesive mass by the application unit, take place preferably in a temporal sequence of steps, in particular following immediately after one another, on the transport line inside the closure unit.

Alternatively, the rotation of the container into the desired rotation position, the application of the adhesive mass by the application unit, and the closure of the container take place in a temporal sequence of steps, in particular following immediately after one another, on the transport line inside the closure unit.

Containers in the meaning of the invention are, for example, bottles, cans, tubes, pouches, in each case made of metal, glass, and/or plastic, for example also including PET bottles, but also other packaging means, in particular those that are suitable for the filling of fluid or viscous products.

"Adhesive or adhesive masses" in the meaning of the invention are, inter alia, all materials or masses with which an adhesive connection between containers is possible, in particular connections, materials, or masses, which, when applied in the fluid or viscous state, form a self-adhering application, and/or under the application of pressure and/or by the application of energy and/or after a hardening or cross-linking (also after energy application) causes an adhesive connection to be formed. "Adhesive or adhesive masses" in the meaning of the invention are, inter alia, also multilayer materials, e.g. such as consist of at least one carrier material, which is coated with a material with which an adhesive connection between containers is possible, in other words are active in adherence and/or adhesion, on at least two sides. Such adhesive or adhesive masses can be designated as pads. An "adhering" container in the meaning of the invention comprises adhesive or adhesive means, or is provided with an application of adhesive or adhesive means. The adhesive or adhesive means is preferably selected in such a way that the containers can be detached by hand and without destruction from the bundle or separated from one another. It is conceivable that fluid adhesive means are applied by the application elements. It is also possible that a low-viscosity UV-cured adhesive is applied. Also suitable would be a hot-melt adhesive or heat adhesive, but which cools very rapidly, and would therefore be able to emit its adhesive properties before the containers of the bundle are adequately bonded to one another.

A UV-cured adhesive is also advantageous in respect of the especially easy adjustment of its desired properties. An appropriate curing station or curing line is preferably provided downstream of the application elements, stationary, or along the linear transporter, above it or, if appropriate, also below it. A curing station can, for example, be a tunnel with UV lighting. The curing station is preferably arranged downstream of the closure device, preferably at the linear transporter.

The expression "essentially" or "approximately" in the meaning of the invention means deviations from the respective exact value by +/−10%, preferably by +/−5% and/or deviations in the form of changes which are not of significance for the function.

Further embodiments, advantages, and possible applications of the invention are also derived from the following description of exemplary embodiments and from the figures. In this context, all the features described or represented as images are in principle, alone or in any desired combination, the object of the invention, regardless of their relationship in the claims or references to them. The content of the claims is likewise a constituent part of the description.

BRIEF DESCRIPTION OF THE DRAWINGS

The invention is described in greater detail hereinafter on the basis of the figures relating to exemplary embodiments. The figures show.

DETAILED DESCRIPTION

Figure 1:
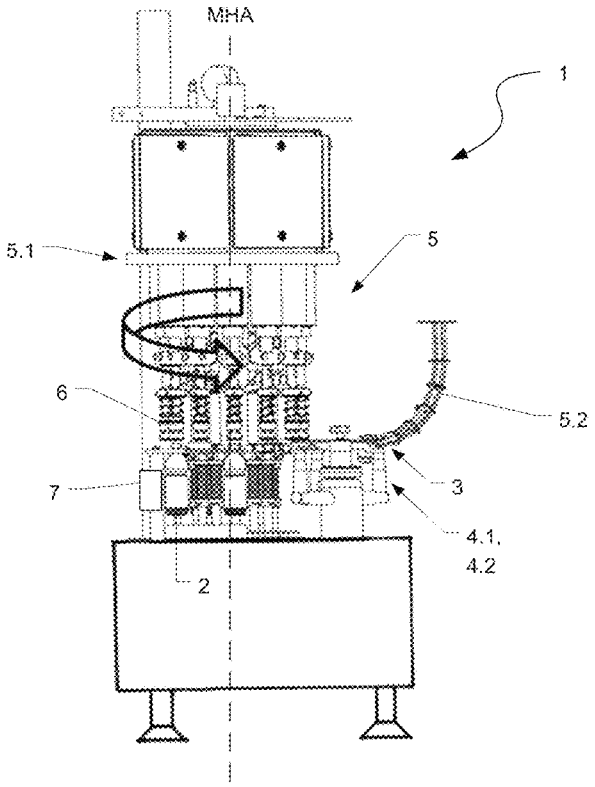
FIG. 1 shows a side view of a first embodiment of a device for the closing of containers.

FIG. 1 shows a closure unit 5 for closing containers 2 with closures 3, and in particular, with screw closures. The closure unit 5 comprises a container delivery element 4.1 that delivers filled but unclosed containers 2 to the closure unit 5 according to their machine division arrangement.

The closure unit 5 comprises a transport element 5.1. In some embodiments, the transport element 5.1 is a rotor that is driven to rotate about a vertical machine axis MHA. The rotor is driven either continuously or intermittently. In other embodiments, the transport element 5.1 is a transport band or a transport chain, such as a linear conveyor.

The transport element 5.1 transports the containers 2 that are to be closed along a transport route. Some embodiments close the containers as they move during this transport. Other embodiments operate intermittently. These intermittently-operating embodiments close the container 2 during a standstill phase of the transport element 5.1. In this situation, a closure-element delivery device 5.2 delivers at least one closure head 6 to the area of the transport element 5.1. The closure head 6 then places these closures 3 onto the containers 2. Depending on the closure mechanism used, the closures 3 are screwed on or molded on. Other closure mechanisms are in principle also possible.

As shown in FIG. 1, the closure unit 5 includes closure stations that move synchronously with the transport element 5.1. Each closure station includes a closure head 6 along with either a container carrier or a container holder. The closure stations are provided at a rotor that is driven to rotate continuously.

The container carrier or container holder can be formed in a variety of ways. In some embodiments, it includes a neck ring holder, a container standing surface, or a stand plate. Some embodiments integrate it into the closure head 6 itself. Among these are embodiments that have a neck ring gripper integrated into the lower free end of the closure head 6.

After the transfer of the containers 2 to the closure unit 5, the containers 2 are then moved together with the closure heads 6 from the container delivery element 4.1 to a container outlet 4.2. Their container openings 2.1 are then closed.

FIG. 1 further shows an adhesive applicator 7 along the area a transport route between the container delivery element 4.1 and the container outlet 4.2. The adhesive applicator 7 applies adhesive spots onto the containers 2 either before or after the container has been closed. Preferably, the adhesive applicator 7 is stationary so that the transport element 5.1 brings the containers 2 to the adhesive applicator 7 for application of adhesive spots at one or more points on the container 2.

A variety of adhesive applicators 7 are possible. These include adhesive applicators 7 structured and configured for application of a fluid adhesive material and a viscous adhesive material. Examples of such materials include hot adhesive and UV-curable adhesive. An adhesive applicator 7 can also be configured for application of adhesive pads.

As noted above, the adhesive applicator 7 can apply adhesive spots at one or more points on the container 2. These adhesive spots can be distributed over the circumference of the container 2. A particularly useful configuration is one in which adhesive spots are offset by 90° or essentially by 90° to one another. This configuration enables the container 2 to easily connect to adjacent containers 2 within a container bundle.

An embodiment that is particularly useful for applying adhesive spots at plural circumferential angles includes plural adhesive applicators 7 at the closure unit 5. By suitably rotating the container 2 about its upright axis BHA, these adhesive applicators 7 apply adhesive at different locations that are angularly offset from each other.

Figure 2:
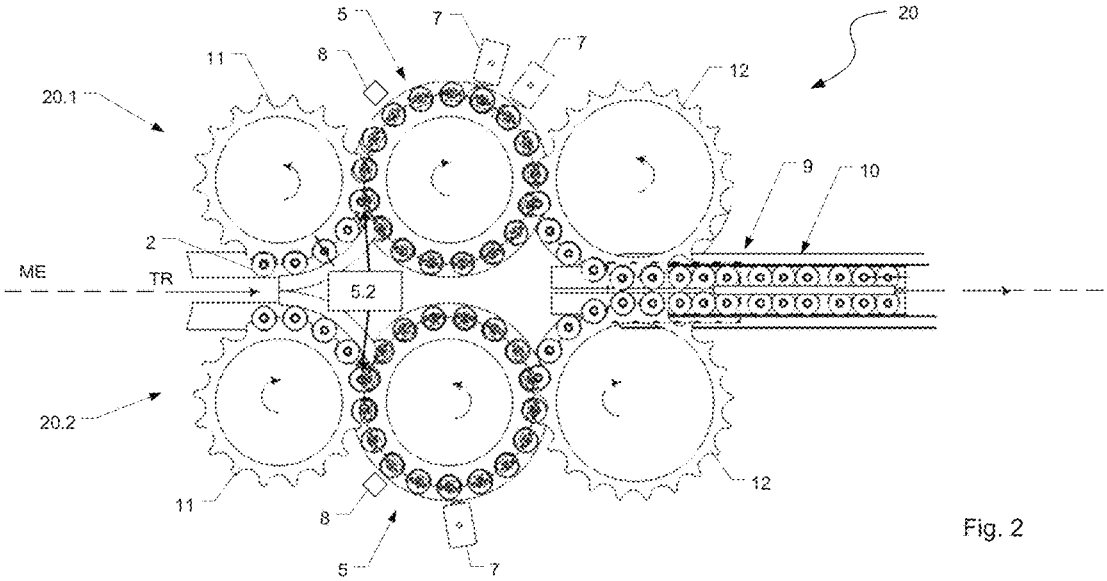
FIG. 2 shows a top view of the embodiment shown in FIG. 1.

FIG. 2 shows a device 20 for producing multi-row bundles of containers 2 by adhesively bonding the containers 2 to one another. The illustrated device 20 includes closure units 5 as described in connection with FIG. 1. The device 20 features mirror symmetry relative to a mid-plane ME. On one side of the mid-plane ME is a first processing area 20.1 and on the other side is a second processing area 20.2 that operates in a direction opposite to that of the first processing area 20.1. Hereinafter, only the structure and function of the first processing area 20.1 is described. The same description applies to the second processing area 20.2.

A transporter delivers containers 2 along a transport direction TR to an inlet star 11. These containers 2 stand upright with their container openings 2.1 open. The inlet 11 passes the containers 2 to the closure unit 5. The closure unit 5 then moves the containers 2 to an outlet star 12. The outlet star 12 then passes the containers 2 on to a grouper 9.

Along a portion of the transport route that lies between the inlet star 11 and the outlet star 12, the closure unit 5 closes the containers 2 and the adhesive applicator 7 applies adhesive to the containers. This can occur in either order. In some embodiments, the adhesive applicator 7 applies adhesive immediately after container delivery from the inlet star 11, before the containers have been closed. In others, the adhesive applicator 7 applies adhesive after the closure unit 5 has closed the containers 2.

Many containers 2 have printed matter on an outer surface thereof. This printed matter can be on a label or it can be printed directly on the container 2. In either case, it is preferable not to apply adhesive on the printed matter. Thus, some embodiments feature a rotation device to rotate the container about its container axis BHA relative to the adhesive applicator 7. By suitably rotating the container into a desired rotation position, it becomes possible to ensure that the adhesive applicator 7 applies adhesive in the correct position relative to any printed matter on the container.

An issue that arises when rotating a container 2 is how much the container 2 should be rotated to reach the desired rotation position. To answer this question, it is useful to provide a sensor 8 in the area of the closure unit 5 for providing data from which it becomes possible to determine the container's actual rotation position. In some embodiments, the sensor 8 includes an optical detection system for the detection of specific equipping features or markings. In other embodiments, the sensor 8 detects other container-specific features, such as contours or identifiers.

In either case, a controller receives data from the sensor 8 and uses it to determine the container's actual rotation position. It then compares the container's actual rotation position with a desired rotation position. Based on this comparison, the controller calculates or derives a suitable rotation angle to cause the container to rotate into the desired rotation position.

The controller causes the container 2 to rotate through the suitable rotation angle, thus causing the container 2 to rotate out of its actual rotation position and into the desired rotation position. An angle-determining sensor detects an extent to which the container 2 has been rotated. Examples of an angle-determining sensor 8 include an incremental encoder or transmitter. After the controlled rotation into the desired rotation position, the adhesive applicator 7 applies adhesive to the container 2.

As shown in FIG. 2, a closure unit 5 can have two or more adhesive applicators 7 at different positions along the transport route.

In some embodiments, a first adhesive applicator 7 applies adhesive to the container 2 when the container is at a first rotation position, and a second adhesive applicator 7 applies adhesive to the container 2 when the container is at a second rotation position that is offset from the first by a fixed angle. A particularly useful offset is 90° since this offset permits containers 2 to be easily combined into rectangular arrays.

In other embodiments, the plural adhesive applicators 7 are arranged above one another in a direction parallel to the upright axis of the container BHA at the closure unit 5. In these embodiments, plural adhesive spots can be applied at a fixed rotation position, with one being above the other. Application of adhesive spots in this configuration promotes stable connection between containers 2.

The closure head 6 rotates a container 2 to the desired rotation angle as the container 2 makes its way along the transport route towards the adhesive applicator 7. The closure head 7 includes a rotationally-driven element that screws the closure 3 onto the container opening. This rotationally-driven element also rotates the container 2 as a whole into the desired rotation position so that the adhesive applicator 7 can apply adhesive at the desired location.

In some embodiments, the closure head 6, together with its rotationally-driven element, engages the mouth of the container 2. In these embodiments, the closure head 6 rotates the unclosed container 2. In alternative embodiments, the closure head 6, together with its rotationally-driven element, engages a closure 3 already screwed onto the container. In this case, the closure head 6 rotates a closed container. Controlled rotation of the rotationally-driven element thus rotates the container 2 about its upright container axis BHA.

When rotating the container 2, it is useful to ease the load on the container 2. Doing so promotes easier rotation. One way to ease the load is to apply a slight lifting force to the closure head 6. Another way to ease the load is to slightly raise the container 2.

Alternatively, the container's side engages an effect element. Rotating or moving the effect element in a controlled manner thus rotates the container 2.

In another alternative, the container 2 stands upright on a stand plate, which can then be rotated in a controlled manner. This allows the container 2 to rotate either in a closed or unclosed state.

Regardless of what actually rotates the container 2, rotation must be complete by the time the container 2 reaches the adhesive applicator 7.

In those cases in which plural adhesive applications take place at different angles, a further controlled rotation of the container 2 can take place on the transport route between a first adhesive applicator 7 and a second adhesive applicator 7. This permits adhesive spots on the container to be separated by different angles, and in particular, by a ninety degree angle. As a result, the container 2 can more easily be integrated into a multi-row bundle in which one adhesive spot connects the container 2 to another container in the same row and the other adhesive spot connects the container 2 to another container that is in the same column.

The adhesive applicators 7 can also be formed on a part of the transport route in such a way as to be moved jointly.

A container 2 arrives at the grouper 9 with its adhesive still moist. The grouper 9 groups containers 2 to form the bundles. This occurs as the containers continuously move along a linear conveyor. Such grouping occurs by bringing containers 2 close to one another in such a way that the adhesive spots adhesively engage adjacent containers 2.

To promote adhesive engagement, the containers run through a compacter 10. The compacter 10 presses containers 2 against one another to promote a strong adhesive bond between them. In some embodiments, a hardener disposed near the area of the grouper 9 and/or the compacter 10 hardens or cross-links the adhesive. For those adhesives that respond to UV, a suitable hardener includes a UV lamp. Alternatively, the hardener can be an arrangement of UV lamps, for example in a curing tunnel. In other embodiments, the hardener exposes the adhesive to thermal energy. The result of this procedure is a bundle.

Some embodiments include a gripper insert introduced between the containers 2 in the area of the grouper 9.

In other embodiments, after the adhesive has been cured or hardened, grippers are applied to the bundles. Examples of grippers are loop-shaped gripping bands. The bundles formed in this way can then be conveyed away and stacked on pallets in a suitable manner.

By means of the device shown in FIG. 2, with which, in parallel operation by a plurality of closure units 5, closure of the containers 2 or, respectively, the application of adhesive to these containers 2, takes place, it is possible for multi-row bundles to be produced in an optimum manner, since every closure unit 5 provides rows of containers 2 that can later be grouped and processed to form bundles. This promotes gathering of precisely-positioned containers 2. As a result, when the containers 2 are brought close to one another or pressed together, areas at which the adhesive has been applied engage each other effectively.

Figure 3:
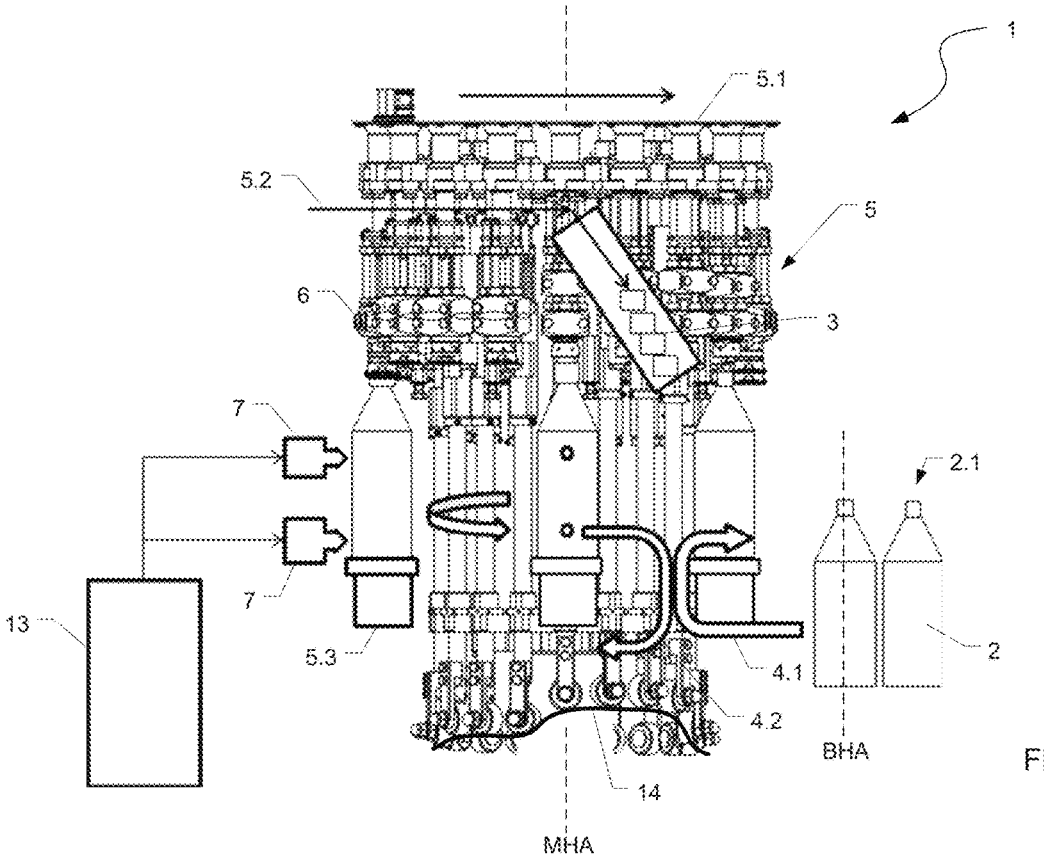
FIG. 3 shows a side view of a second embodiment of a device for the closing of containers.

FIG. 3 shows a further exemplary embodiment of a closure unit 5 having a plurality of closure heads 6 held at a machine element that is driven about the machine axis MHA. In addition, the closure unit 5 has stand plates 5.3 that function as container carriers. Containers 2 stand on these stand plates 5.3. Each stand plates 5.3, of which only a few are represented schematically in FIG. 3, is allocated to a closure head 6 and rotates preferably synchronously with the closure heads 6. A container 2 delivered at the container delivery element 4.1 is arranged on a container carrier and moved jointly with this, preferably continuously, until it is taken off at the container outlet 4.2.

The application of the adhesive takes place once again on the transport route between the container delivery element 4.1 and the container outlet 4.2. For this purpose, in the exemplary embodiment shown, two adhesive applicators 7 are provided above one another. A supply line connects these adhesive applicators 7 to an adhesive storage unit 13. The adhesive applicators 7 are arranged so that adhesive can be applied in the waist area and/or slightly above the container base. In some embodiments, the adhesive applicators 7 are vertically displaceable and capable of being pivoted about a vertical axis. These embodiments are particularly advantageous because they permit adjustment so as to position them for application of adhesive at an optimum application angle.

A delivery device 5.2 delivers closures 3 to respective closure heads 6. As a container 2 moves along a first part of the transport route, it arrives at the closure unit 5. Upon introduction of the container 2 into the closure unit 5, a control curve 14 lowers a closure head 6 that is located above that container 2 onto the container's mouth, thereby introducing a closure 3 onto the container opening 2.1. In some embodiments, this closure 3 is to be screwed on.

As the container 2 to move along, it rotates into a desired rotation position. Embodiments include those in which the closure head 6 carries out this rotation and those in which the stand plate 5.3 carries out this rotation. Optionally, as the container 2 rotates, the control curve 14 raises the closure head 6 slightly off the container 2. This reduces the clamping force and makes the container 2 easier to rotate.

After the desired rotation position has been reached, as the container 2 passes by the adhesive applicator 7, the adhesive applicator 7 applies adhesive to the container 2. Finally, the control curve 14 raises the closure head 6 from the container 2 and causes removal of the container at the container outlet 4.2.

Figure 4:
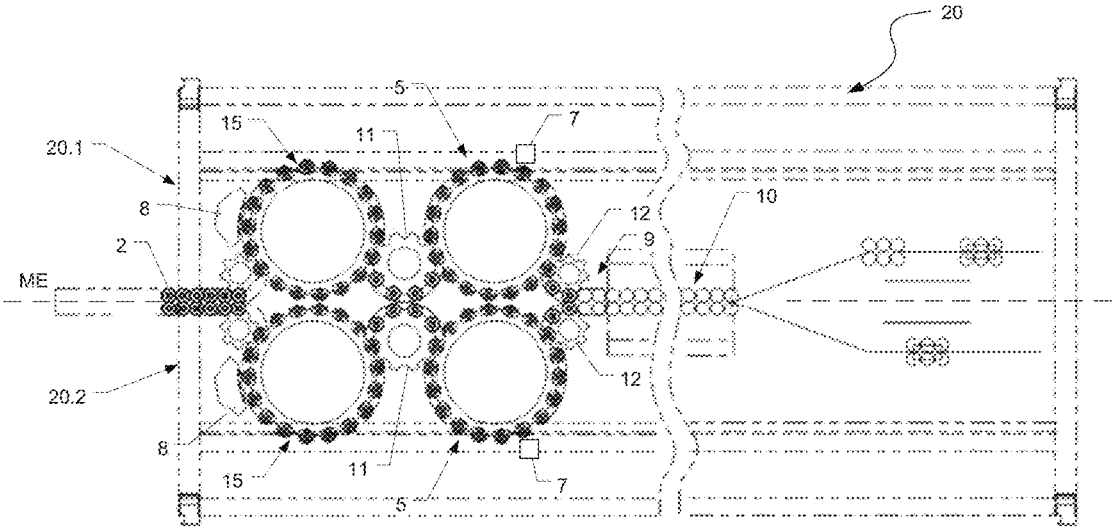
FIG. 4 shows, a top view of the embodiment shown in FIG. 3.

FIG. 4 shows a further embodiment of a bundle production device 20 similar to that shown in FIG. 2.

Unlike the embodiment shown in FIG. 2, the embodiment shown in FIG. 4 includes an alignment unit 15 upstream of the closure units 5. In the particular embodiment shown, this alignment unit 15 is implemented as an alignment star that aligns containers 2 into their desired rotation positions upstream of the closure unit 5.

To promote correct rotation, the embodiment shown also includes a sensor 8 in the area of the alignment unit 15. The sensor 8 detects the actual rotation position of the container 2 can be detected so that an extent of the required rotation can be determined. Some embodiments implement the sensor 8 using an optical detection system that detects specific equipping features or markings.

Once the sensor 8 detects the actual rotation position, it transmits that information to a control unit, which then compares it with a stored desired rotation position. The control unit then causes the alignment unit 15 to rotate the container 2 into the desired rotation position. This can be carried out, for example, by rotating a surface on which the container stands or by gripping the container's mouth and rotating it.

In some embodiments, the rotation takes place at or near the alignment unit 15. For these embodiments, it is useful to ensure that no further rotation takes place between the alignment unit 15 and the closure unit 5. However, in others embodiments, only detection of the actual rotation position takes place at or near the alignment unit 15. In these embodiments, the actual rotation takes place near the closure unit 5.

The remaining structure of the bundle production device 20 corresponds essentially to the structure in FIG. 2, such that reference is made to description relating to that.

Figure 5A:
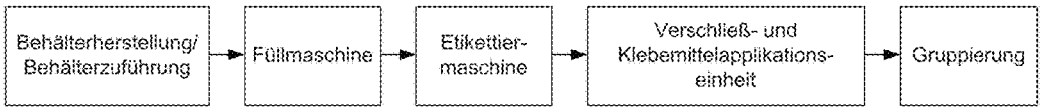
FIG. 5*a* shows steps in a method for the integration of a closure device into the filling and container production process according to a first embodiment.
Figure 5B:
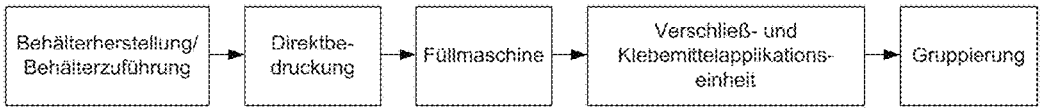
FIG. 5*b* shows steps in a method for the integration of a closure device into the filling and container production process according to a second embodiment.
Figure 5A:
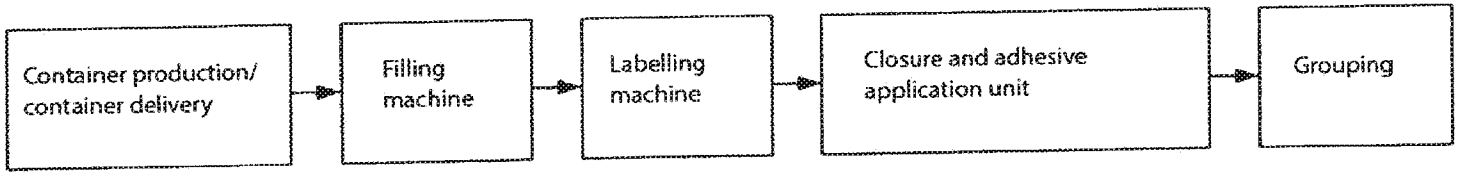
Figure 5B:
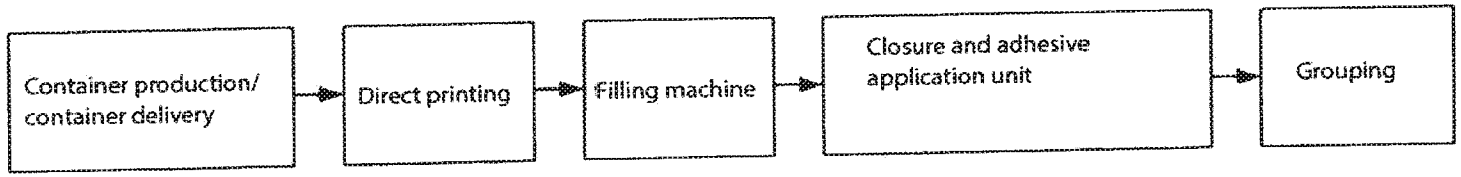

FIGS. 5*a* and 5*b* show in block diagrams the possible integration of a closure unit 5 into the overall process of the production of filled containers.

After the production of the containers (e.g. blow-molding machine for the production of PET bottles) or the provision of cleaned, fillable containers, these can be filled and labeled directly (FIG. 5*a*) or subjected initially to a direct printing (direct print of equipping features onto the container wall) and then filled (FIG. 5*b*).

In either case, the filled containers 2, after having been printed upon or labeled as described above, are transferred to a closure unit 5 for closing. Within the closure unit 5, closures close the containers and an adhesive applicator 7 applies adhesive to the containers. The containers 2 are then grouped and processed to form adhesive-connected bundles in which the containers 2 are connected to one another using the applied adhesive. These bundles can then be stacked on pallets and transported away.

Some embodiments also include block arrangements that directly couple to treatment machines. In such cases, transport stars handle containers by their necks as they transport them between handling machines. The transport stars typically do so by using grippers or clamps to engage the containers' necks.

In the embodiments described herein, such blocking arrangements can be applied to at least the closure unit 5 with the adhesive applicator 7 allocated to it, and the grouper 9 located downstream with a labeling machine and/or filling machine located upstream.

The invention has been described heretofore by way of exemplary embodiments. It is understood that numerous amendments or derivations are possible without departing from the inventive concept on which the invention is based.

Having described the invention, and numerous embodiments thereof, what is claimed as new and secured by Letters Patent is:

1. An apparatus comprising:

a closure unit comprising:

a container-delivery element, a transport element defining a transport route, a closure head, and a first adhesive applicator, and a grouper, wherein said container-delivery element is structured and configured to deliver a first unclosed container to said transport element, wherein said closure head is structured and configured to permit a closure to be screwed onto a container opening of the first container along a portion of the transport route to close the first container, wherein said first adhesive-applicator is structured and configured to apply a first adhesive-spot to a desired location on a circumferential side wall of said first container at a position along the transport route, wherein said closure unit is structured and configured to provide controlled rotation of said first container about a vertically-oriented container axis thereof to position the first container to receive the first adhesive spot at the desired location on the circumferential side wall of the first container, and wherein said grouper is structured and configured to bring said first container and a second container together to promote adhesive engagement between said containers, thereby forming a bundle of at least said first and second containers.

2. The apparatus of claim 1, wherein said closure head causes said first container rotation of said container.

3. The apparatus of claim 1, wherein said controlled rotation of said first container takes place through rotation of a surface with which said first container is in contact.

4. The apparatus of claim 1, wherein said controlled rotation of said first container takes place through rotation of a surface upon which said first container stands.

5. The apparatus of claim 1, further comprising a sensor, wherein said sensor is configured to detect an actual rotation position of said first container.

6. The apparatus of claim 1, further comprising a rotation-angle sensor for determining an extent to which said first container has rotated.

7. The apparatus of claim 1, wherein said closure unit comprises said transport element for transport of said first container from said container delivery element to a container outlet.

8. The apparatus of claim 7, wherein said transport element is configured to rotate continuously.

9. The apparatus of claim 7, wherein said transport element is configured to rotate intermittently.

10. The apparatus of claim 7, wherein said transport element comprises a rotor configured to rotate about a vertical machine axis.

11. The apparatus of claim 1, further comprising a compacter on which containers are pressed together to promote adhesive connection between said containers.

12. The apparatus of claim 11, further comprising a hardener disposed at said compacter.

13. The apparatus of claim 1, further comprising a second adhesive-applicator, wherein said second adhesive-applicator applies a second adhesive-spot to said circumferential side wall of said first container, wherein said first and second adhesive-spots are at different circumferential angles.

14. The apparatus of claim 13, wherein said first and second adhesive-spots are offset by ninety degrees.

15. The apparatus of claim 13, wherein said first adhesive-applicator is configured to apply said first adhesive-spot prior to said controlled rotation and said second adhesive-applicator is configured to apply said second adhesive-spot after said controlled rotation.

16. The apparatus of claim 1, wherein said first adhesive-applicator is configured to apply said first adhesive-spot prior to said controlled rotation.

17. The apparatus of claim 1, wherein said first adhesive-applicator is configured to apply said first adhesive-spot after said controlled rotation.

18. A method for forming a bundle of containers, wherein the method comprises:

delivering filled containers to a closure unit, said containers being at least one of labeled and printed upon before being delivered to the closure unit, providing closures for closing each of said containers at said closure unit, closing each of said containers with a corresponding closure at said closure unit, rotating each of said containers about a vertical axis thereof within said closure unit to orient said containers, applying adhesive onto circumferential side walls of said rotated and oriented containers at said closure unit, after having applied adhesive onto said circumferential side walls, removing said closed containers from said closure unit and bringing said closed containers together to promote adhesive engagement between said closed containers, and compacting said adhesively engaged closed containers to form said bundle.

19. The method of claim 18, wherein rotating each of said containers about a vertical axis thereof comprises using a closure head to rotate a container.

20. The method of claim 18, further comprising causing rotating each of said containers about a vertical axis thereof, applying adhesive onto said circumferential side walls of said containers, and closing each of said containers with a corresponding closure all occur in sequence within a transport route inside said closure unit.

* * * * *